US006090033A

United States Patent [19]

Simmons, Jr.

[11] Patent Number: 6,090,033

[45] Date of Patent: Jul. 18, 2000

[54] CUSHIONING CONVERSION MACHINE FOR PRODUCING U-SHAPE PADS

[75] Inventor: James A. Simmons, Jr., Painesville, Ohio

[73] Assignee: Ranpak Corp., Painesville Township, Ohio

[21] Appl. No.: 09/146,070

[22] Filed: Sep. 2, 1998

Related U.S. Application Data

[60] Provisional application No. 60/057,858, Sep. 2, 1997.

[51] Int. Cl.[7] ..... B31B 2/24

[52] U.S. Cl. ..... 493/464; 493/967

[58] Field of Search ..... 493/464, 967, 493/460, 461, 462

[56] References Cited

U.S. PATENT DOCUMENTS

| | | | |
|---|---|---|---|
| 3,650,877 | 3/1972 | Johnson | 161/47 |
| 4,026,198 | 5/1977 | Ottaviano | 93/1 WZ |
| 4,085,662 | 4/1978 | Ottaviano | 93/1 WZ |
| 4,109,040 | 8/1978 | Ottaviano | 428/129 |
| 4,237,776 | 12/1980 | Ottaviano | 493/382 |
| 4,557,716 | 12/1985 | Ottaviano | 493/464 |
| 4,650,456 | 3/1987 | Armington | 493/464 |
| 4,717,613 | 1/1988 | Ottaviano | 428/129 |
| 4,750,896 | 6/1988 | Komaransky et al. | 493/457 |
| 4,968,291 | 11/1990 | Baldacci et al. | 493/354 |
| 5,123,889 | 6/1992 | Armington et al. | 493/352 |
| 5,181,614 | 1/1993 | Watts | 266/584 |
| 5,257,492 | 11/1993 | Watts | 53/430 |
| 5,322,477 | 6/1994 | Armington et al. | 493/346 |
| 5,383,837 | 1/1995 | Watts | 493/352 |
| 5,425,696 | 6/1995 | Hara et al. | 493/414 |
| 5,439,730 | 8/1995 | Kelly et al. | 428/156 |
| 5,468,525 | 11/1995 | Watts | 428/34.1 |
| 5,487,717 | 1/1996 | Tekavec et al. | 493/352 |
| 5,681,255 | 10/1997 | Simmons | 493/464 |
| 5,816,995 | 10/1998 | Tekavec et al. | 493/352 |
| 5,823,936 | 10/1998 | Ratzel | 493/464 |

*Primary Examiner*—Joseph J. Hail, III
*Assistant Examiner*—Dermott J. Cooke
*Attorney, Agent, or Firm*—Renner, Otto, Boisselle & Sklar LLP

[57] ABSTRACT

Cushioning conversion machine and method for converting a sheet stock material into U-shape strips of dunnage. The machine and method are characterized by at least one conversion assembly which converts the sheet stock material into a strip of dunnage, an outlet through which the strip of dunnage emerges and which defines an exit path of the strip of dunnage, and a capture device disposed in the exit path of the strip of dunnage emerging from the outlet and being operative to cause the emerging strip of dunnage to be progressively bent into a U-shape and then removed while retaining the U-shape.

21 Claims, 4 Drawing Sheets

CUSHIONING CONVERSION MACHINE FOR PRODUCING U-SHAPE PADS

RELATED APPLICATION DATA

This application claims priority of U.S. Provisional Patent Application No. 60/057,858 filed on Sep. 2, 1997.

FIELD OF THE INVENTION

The invention herein described relates generally to a cushioning conversion machine and, more particularly, to a cushioning conversion machine for producing a U-shape cushioning product.

BACKGROUND OF THE INVENTION

Cushioning conversion machines heretofore have been used to convert sheet stock material, such as paper in multi-ply form, into low density cushioning products, or pads. Examples of these machines are disclosed in U.S. Pat. Nos. 4,026,198; 4,085,662; 4,109,040; 4,237,776; 4,557,716; 4,650,456; 4,717,613; 4,750,896; 4,968,291; 5,123,889; and 5,322,477. These machines include a forming assembly through which the sheet stock material is advanced by a feed assembly. The forming assembly causes the sheet stock material to be inwardly rolled on itself and crumpled to form a relatively low density strip of cushioning. The strip of cushioning, which is guided out of the machine by an exit chute, may be severed to form pads of desired lengths by a severing assembly located downstream of the forming and feeding assemblies.

The pads produced by the aforesaid and other conversion machines have been generally straight sections. For some packaging applications, the pads are bent by a packer into a U-shape before placement in a container such as a box. Although the pads are relatively flexible and easy to bend into a U-shape, the bending procedure takes extra time and can become tiring when done repeatedly. Therefore, it would be advantageous if the pads already had a U-shape when presented to the packer for placement in the container.

SUMMARY OF THE INVENTION

The present invention provides a cushioning conversion machine and method for converting a sheet stock material into U-shaped strips of dunnage. The machine and method are characterized by at least one conversion assembly which converts the sheet stock material into a strip of dunnage, an outlet through which the strip of dunnage emerges and which defines an exit path of the strip of dunnage, and a capture device disposed in the exit path of the strip of dunnage emerging from the outlet and being operative to cause the emerging strip of dunnage to be progressively bent into a U-shape and then removed while retaining the U-shape.

According to a preferred embodiment of the invention, the capture device includes a holder for capturing a leading end of the strip of dunnage emerging from the outlet and for holding the leading end such that the emerging strip is caused to be progressively bent into the U-shape. The holder preferably is mounted with respect to the outlet for movement relative to the outlet between a first position disposed in the exit path of the strip of dunnage emerging from the outlet and a second position relatively rotated and transversely offset from the first position. With this arrangement, the holder is operative to hold the leading end of the strip of dunnage for rotating movement with the holder as the holder is caused by the emerging strip to move from the first position to the second relatively rotated position, whereby the emerging strip is caused to be progressively bent into a U-shape.

Further in accordance with a preferred embodiment of the invention, the outlet includes a guide chute and the holder is mounted to the guide chute for pivotal movement between the first position and the second position rotated about 140° from the first position. Preferably, the holder is normally biased towards the first position, such that upon removal of a bent pad, the holder returns to its first position to capture the leading end of a next strip of dunnage. A preferred holder includes a pocket in which the leading end of the strip of dunnage is received and held, and the pocket preferably has a relatively wide mouth for receiving the leading end of the strip of dunnage and converging side walls between which the leading end of the strip of dunnage can be wedged for secure holding of the leading end of the strip of dunnage in the holder. However, other devices may be used to hold the leading end of the strip to the holder, including, for example, gripping mechanisms.

As is also preferred, the at least one conversion assembly produces a strip of dunnage having in cross section a major axis and a minor axis, the machine is oriented such that the major axis extends vertically, and the capture device is oriented so as to cause the strip of dunnage to be bent in a horizontal plane. This orientation takes advantage of the higher stiffness of the strip of dunnage along its major axis as opposed to its minor axis, whereby a longer U-shape strip of dunnage may be formed without the need for an external support therefor downstream of the outlet.

The invention also provides a U-shape strip of dunnage produced using the apparatus and method of the invention.

These and other features of the invention are fully described and particularly pointed out in the claims. The following description and annexed drawings set forth in detail one illustrative embodiment of the invention, this embodiment being indicative of but one of the various ways in which the principles of the invention may be employed.

DETAILED DESCRIPTION

Figure 1:
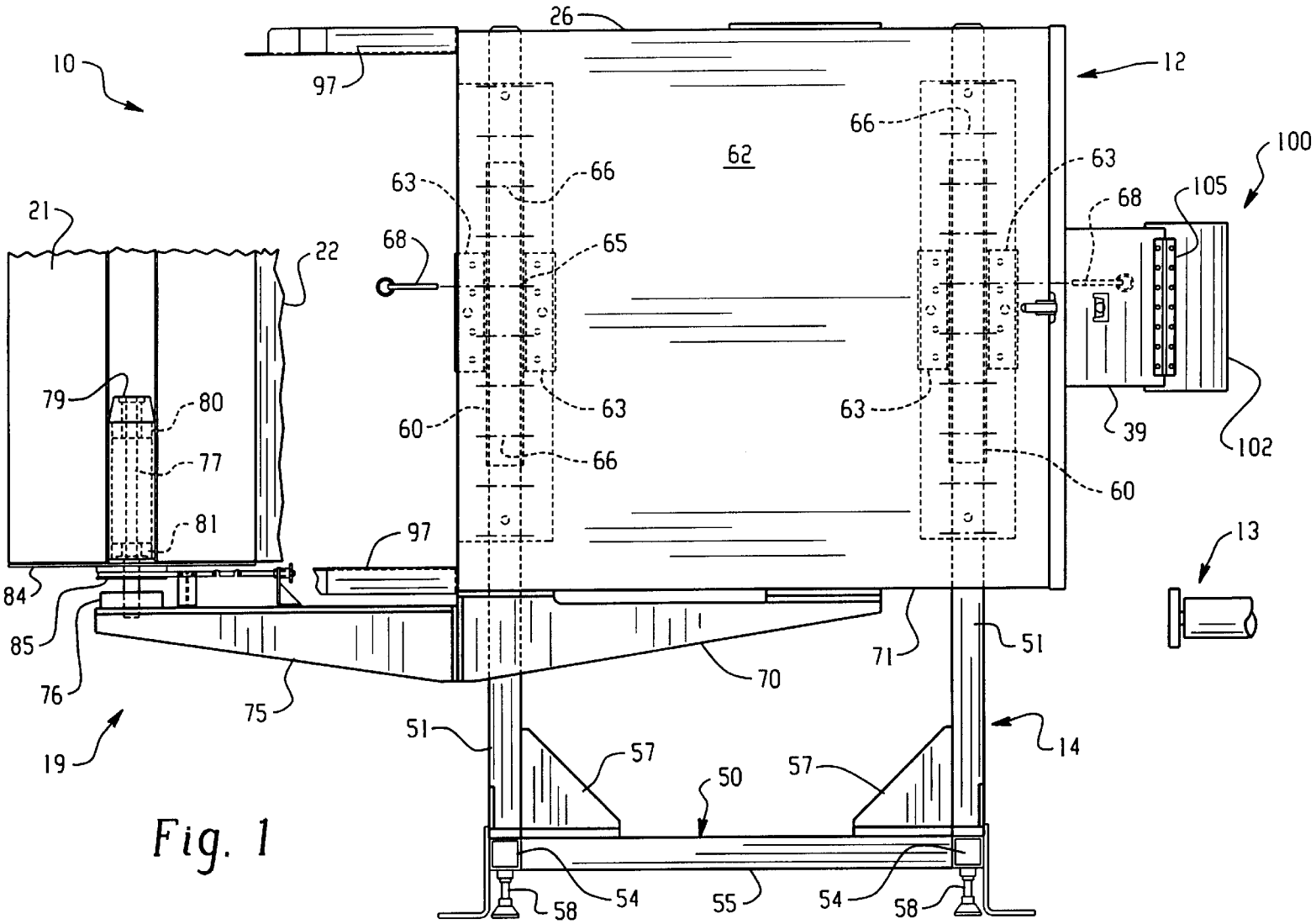
FIG. 1 is a side elevational view of a cushioning conversion machine according to the present invention, incorporated into a packaging system and with some parts removed or broken away for illustration purposes.
Figure 2:
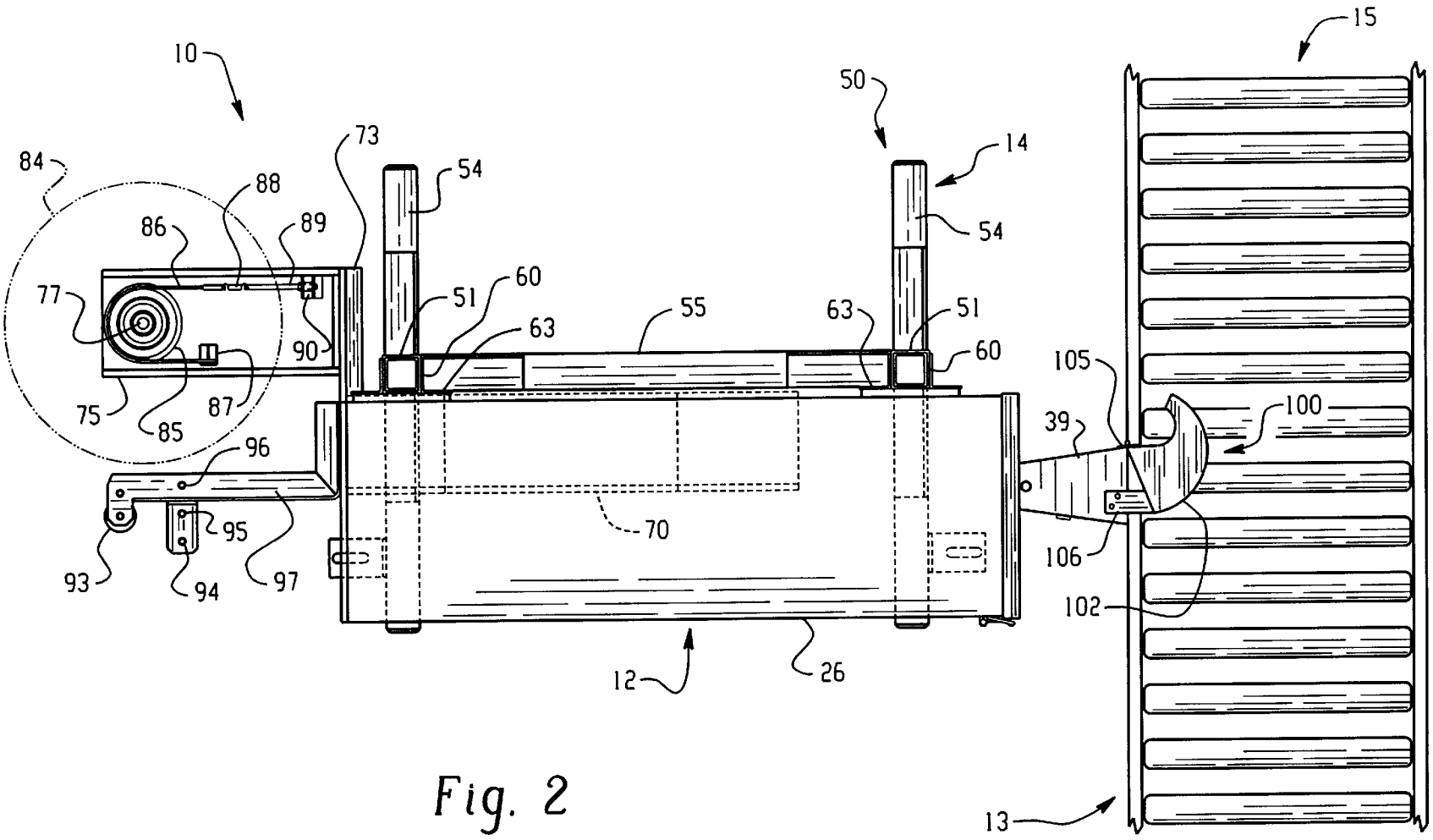
FIG. 2 is a top plan view of the cushioning conversion machine of FIG. 1.

Referring now to the drawings in detail and initially to FIGS. 1 and 2, a packaging system 10 incorporating a cushioning conversion machine 12 according to the present invention is shown. In addition to the cushioning conversion machine 12, the system 10 includes a conveyor 13 and a stand 14 for supporting the conversion machine adjacent the conveyor 13. The conveyor 13 functions as a support for a container, such a carton, to be packed with an article and dunnage surrounding the article to fill the carton and/or cushion the article in the carton. The conveyor also provides a convenient means for transferring the cartons to a packaging station 15 located adjacent the conversion machine 12.

The conversion machine 12 has a stock supply which, in the illustrated embodiment, includes an integral stock roll holder assembly 19 for supporting a roll 21 of sheet stock material 22. The stock material 22 preferably consists of one or more, typically two or three, superimposed plies $P_1$, $P_2$ and $P_3$ (FIG. 3) of biodegradable, recyclable and reusable sheet material, such as Kraft paper rolled onto a hollow cylindrical tube. The machine 12 converts this stock material 22 into a crumpled strip of cushioning/dunnage 24 (FIG. 3) having inwardly folded edge portions interconnected to maintain the cushioning integrity of the cushioning strip. The machine 12 also has provision for severing, as by cutting, the strip to form a discrete pad of desired length, as is further discussed below.

Figure 3:
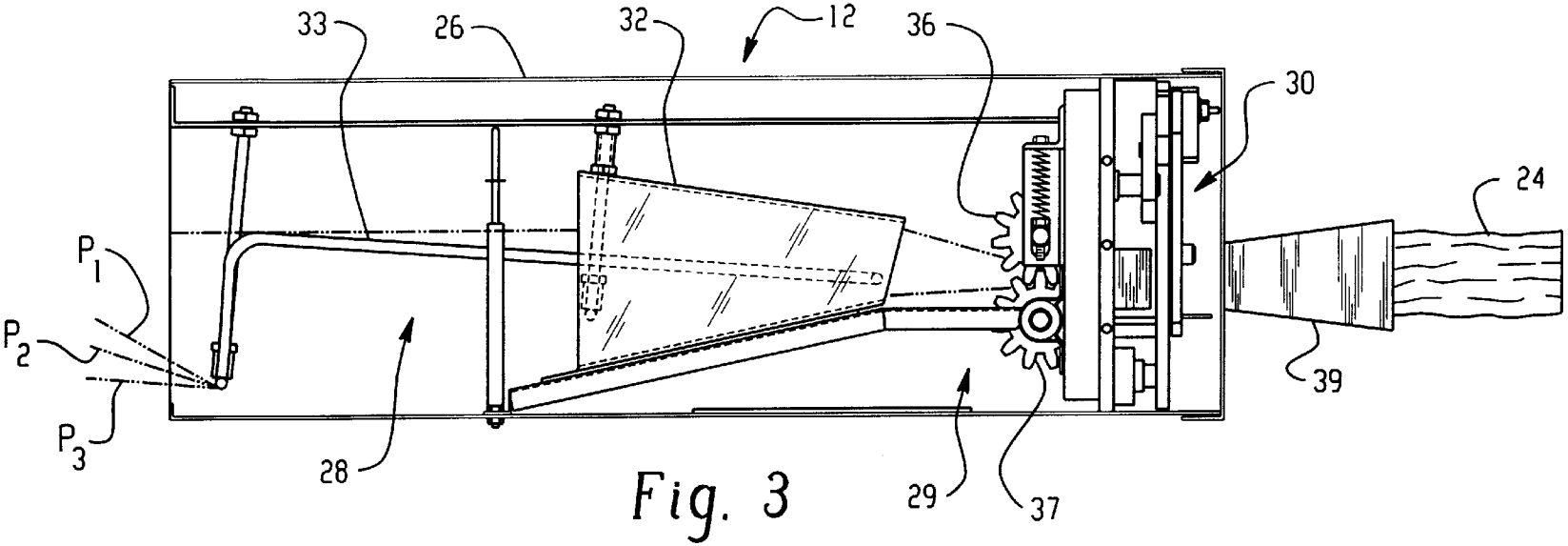
FIG. 3 is a longitudinal cross section of the cushioning conversion machine.

In FIG. 3, internal components of an exemplary type of conversion machine 12 are illustrated. As shown, the machine 12 generally comprises a housing 26 and cushion-producing (conversion) assemblies which are mounted in the housing 26 and which create the pads. The cushion-producing assemblies of the illustrated conversion machine include a forming assembly 28, a feed assembly 29, and a severing assembly 30, all of which are mounted in or to the housing 26. The illustrated forming assembly 28 includes a shaping chute 32 and a forming member 33 for forming the sheet material into a three-dimensional strip that is then connected to form the cushioning strip 24 that is cut to length by the severing assembly 30.

During operation of the machine 12, the stock roll holder assembly 19 (FIGS. 1 and 2) supplies the stock material to the forming assembly 28. The forming assembly causes inward rolling of the lateral edges of the sheet stock material 22 to form a continuous strip having lateral pillow-like side portions and a thinner central band portion. The feed assembly 29, which in the illustrated embodiment includes a pair of cooperating gear-like members 36 and 37, pulls the stock material 22 downstream through the machine and also connects the layers along the central band, as by coining and/or perforating in the illustrated preferred embodiment, to form a connected strip. As the connected cushioning strip travels downstream from the feed assembly 29, the severing assembly 30 cuts the strip into pads of a desired length. The pads exit through a discharge chute 39. For further details of the illustrated and similar cushion-producing machines, reference may be had to U.S. Pat. No. 5,123,889 and published PCT Application No. US96/09109.

Figure 4:
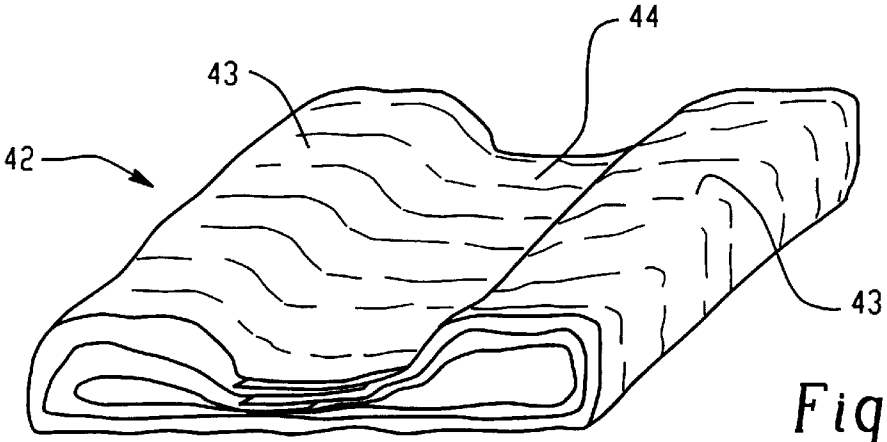
FIG. 4 is a fragmentary perspective view of a pad produced by the machine of FIG. 3.

An exemplary pad is shown in FIG. 4 at 42. The pad 42 comprises the one or more plies of sheet material that have side portions thereof folded over the center portions thereof to form laterally spaced-apart pillow portions 43 extending along the length of the pad. The pillow portions 43 are separated by a central band 44 where lateral edge portions are brought together. The lateral edge portions, which may be overlapped and/or interleaved, are connected together, and/or to underlying center portions of the plies along the central band 44. In the illustrated preferred form of cushioning pad, the connecting is accomplished by a combination of coining and stitching, the stitching being effected by perforations and/or cut tabs disposed along the central band. However, it will be appreciated by those skilled in the art that other types of conversion machines may be used to produce the same or other forms of cushioning strips. For further details of the illustrated pad, reference may be and to published PCT Application No. US96/09109, which is hereby incorporated herein by reference.

Referring again to FIGS. 1 and 2, the housing 26 of the conversion machine 12 has a longitudinal axis corresponding to the direction of passage of the sheet material through the machine. The housing is generally rectangular in cross-section taken transverse to the longitudinal axis of the machine. In the illustrated packaging system 10, the machine is supported by the stand 14 with its wider dimension oriented vertically, i.e., on edge.

The illustrated stand 14 comprises a base 50 and a pair of uprights 51. The base 50 is in the form of an H-frame including parallel side frame members 54 interconnected by a cross frame member 55 at about the midpoints of the side frame members 54. At the intersections between the cross frame member 55 and the side frame members 54, the uprights 51 are attached and extend vertically upwardly. The uprights 51 may be stabilized by suitable means such as by gussets 57 as shown. At the ends of the side frame members, leveling feet 58 are provided for leveling the stand 14 relative to uneven floor surfaces. If desired, casters (not shown) may replace or be used with the leveling feet 58 to facilitate movement of the stand 54 and machine 12 from one location to another.

The conversion machine 12 is mounted to the uprights 51 for vertical adjustment therealong by a pair of guides 60. In the illustrated embodiment, the guides 60 are in the form of tubes which are telescopically movable along the respective uprights 51. The tubes are attached to the base wall 62 of the housing 26 of the machine 12 by brackets 63. One or both tubes 60 and/or brackets 63 have along the length thereof at least one hole 65 alignable with a selected one of a plurality of holes 66 provided in the uprights 51 along the length thereof for receiving pins 68. Accordingly, the machine 12 can be adjusted vertically on the uprights using different combinations of the holes 65 in the guide tubes and the holes 66 in the uprights 51.

As further shown in FIGS. 1 and 2, the stock roll holder assembly 19 includes a base 70 secured to the side wall 71 of the housing 26, the side wall 71 being the side wall disposed at the bottom of the machine when oriented as shown in FIGS. 1 and 2. The base 70 at the rear of the housing has a transversely extending mounting arm 73 which may be in the form of a plate. Attached to the distal end of the mounting arm in a cantilever-like fashion is a stock roll support arm 75. The stock roll support arm has mounted on its distal end remote from the machine housing a mounting block 76 on which a shaft 77 is supported upright. A spindle 79 is supported on the shaft 77 for rotation about the axis of the shaft by suitable bearings 80 and 81. The lower bearing 81 preferably also functions as a thrust bearing which may supported on a step on the shaft 77 in a conventional manner.

The spindle 79 includes at its lower end a circular stock roll support plate 84 against which the end of a stock roll 21 may be supported when a stock roll is loaded onto the holder assembly 19 with the spindle 79 extending into the hollow core of the stock roll as shown in FIG. 1. Attached to the underside of the support plate 84 for rotation therewith is a sheave 85. The sheave 85 has trained thereover a strap 86 having one end attached to an anchor 87 fixed to the arm 75 and its opposite end attached via a spring 88 to an adjustment pin 89 threaded into a block on the arm 75. Accordingly, rotation of the adjustment pin 89 in the block 75 will vary the tension on the strap 86 which will vary the amount of drag acting on the sheave 85 and thus the spindle 79 which supports the stock roll 21. Preferably, the amount of drag is adjusted to prevent overrunning of the stock roll 21 during starting and stopping of the machine 12, which causes significant variation in the amount of tension acting on the stock material 22 being fed into the machine.

Preferably, the tension should be relatively constant for optimum formation of the cushioning strip.

In known manner, the stock material 22 payed off of the stock roll 21 travels over a constant entry roller 93 and then the plies are separated for passage between or over separators 94–96. The constant entry roller 93 and separators 94–96 are mounted between L-shape brackets 97 attached to the rear end of the housing 26. For further details of the constant entry roller and separators, reference may be had to U.S. Pat. No. 5,123,889.

At the front or downstream end of the conversion machine 12 shown at the right in FIGS. 1 and 2, the formed strip of cushioning/dunnage emerges from the housing 26 through the discharge chute 39 which forms the outlet of the machine. The discharge chute 39 preferably has four walls forming a generally rectangular passage which guides the paper along an exit path which, in the illustrated embodiment, is aligned generally with the longitudinal axis of the machine 12. Disposed in this exit path is a capture device 100 which is operative to cause the emerging strip of dunnage to be progressively bent into a U-shape and then removed while retaining the U-shape.

Figure 5:
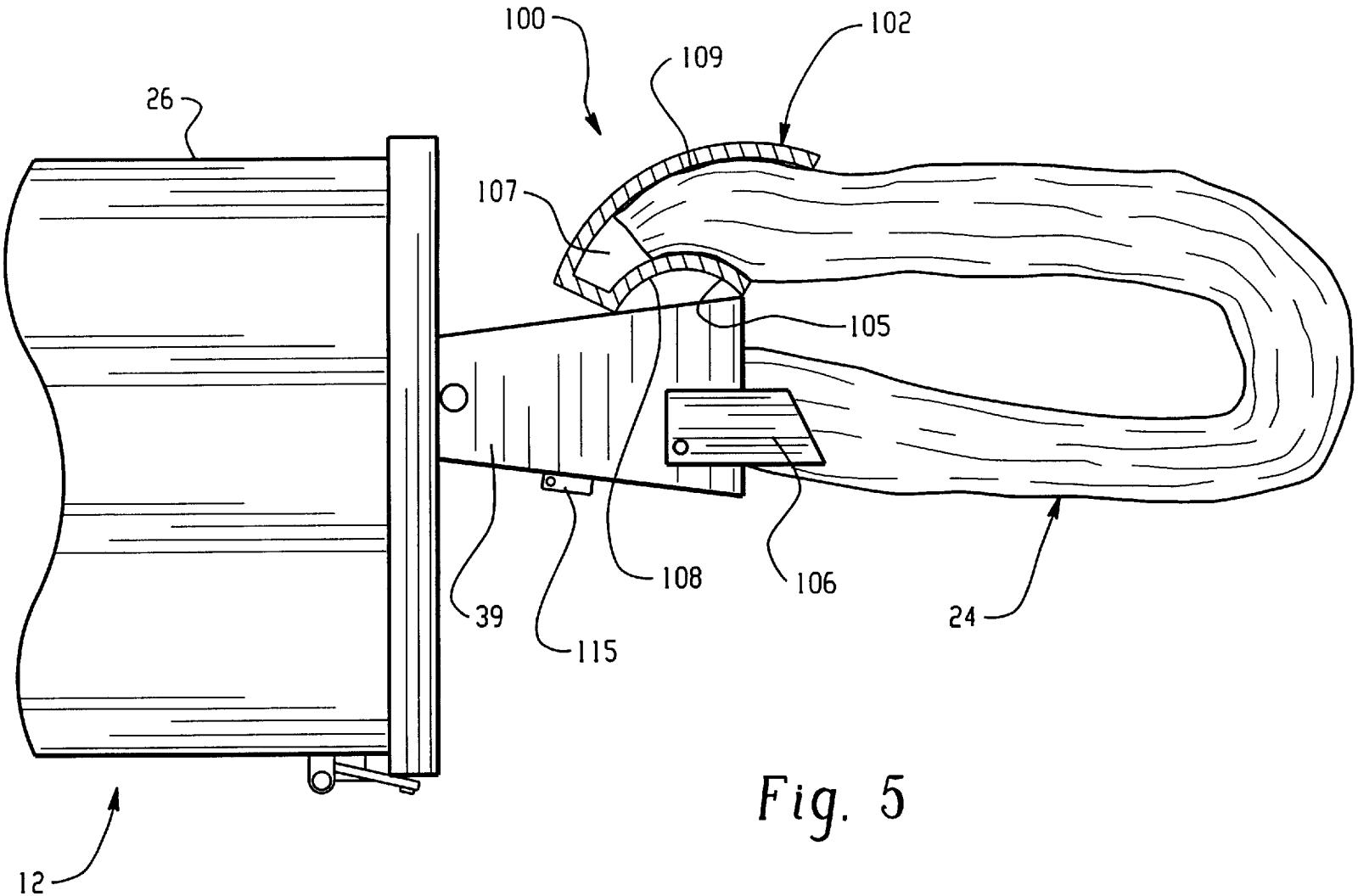
FIG. 5 is an enlargement of a portion of FIG. 2, showing a capture device in a second position rotated away from the position thereof shown in FIG. 2.

The capture device 100 includes a holder 102 for capturing a leading end of the strip 24 of dunnage emerging from the outlet and for holding the leading end such that the emerging strip is caused to be progressively bent into the U-shape. The holder 102 preferably is mounted with respect to the discharge chute 39 for movement relative to the discharge chute between a first position disposed in the exit path of the strip of dunnage emerging from the outlet as shown in FIGS. 1 and 2 and a second position relatively rotated and transversely offset from the first position as shown in FIG. 5. With this arrangement, the holder is operative to hold the leading end of the strip of dunnage for rotating movement with the holder as the holder is caused by the emerging strip to move from the first position to the second relatively rotated position, whereby the emerging strip is caused to be progressively bent into a U-shape. After the U-shape section of the strip has been formed and severed by the severing assembly 30 (FIG. 3), the thus formed U-shape pad can be pulled from the chute and holder while retaining its U-shape. As will be appreciated, the strip when bent as shown will have a memory retaining the pad in its bent shape, by virtue of the physical characteristics of the pad, preferably formed from one or more plies of, for example, 30–50 pound Kraft paper.

The holder 102 preferably is mounted by a hinge 105 or functionally equivalent device to the guide chute 39 for pivotal movement between the first position and the second position rotated about 140° from the first position. Preferably, the holder is normally biased towards the first position, such that upon removal of a bent pad, the holder returns to its first position to capture the leading end of a next strip of dunnage. Such biasing may be effected by any suitable means such as by a spring incorporated into the hinge in a conventional manner. The holder is normally biased against a stop 106 provided on each side of the discharge chute 39.

A preferred form of holder 102 includes a pocket 107 (FIG. 5) in which the leading end of the strip 24 of dunnage is received and held. The pocket 107 preferably has a relatively wide mouth for receiving the leading end of the strip of dunnage and converging side walls 108 and 109 between which the leading end of the strip of dunnage can be wedged for secure holding of the leading end of the strip of dunnage in the holder. However, other devices may be used to hold the leading end of the strip to the holder, including, for example, gripping mechanisms.

As shown in FIG. 4, the pad 42 has in cross section a major axis and a minor axis. In the illustrated orientation of the machine 12, the machine is oriented such that the major axis of the pad's cross section will extend vertically, and the capture device will be oriented so as to cause the strip of dunnage to be bent in a horizontal plane. This orientation takes advantage of the higher stiffness of the strip of dunnage along its major axis as opposed to its minor axis, whereby a longer U-shape strip of dunnage may be formed without the need for an external support therefor downstream of the discharge chute 39 as shown in FIG. 5. However, if desired, a support platform may be provided for the bent end of the U-shape pad. The use of a support platform will enable formation of larger U-shape pads. Those skilled in the art will also appreciate that the machine may be otherwise oriented, such as with the base 62 (FIG. 1) located at the bottom of the machine, in which case the pad would be bent in a vertical plane.

If desired, the holder 102 may be moved to an out of the way position if production of a straight pad is desired. For example, a latch or clip may be provided to hold the holder in its position shown in FIG. 5, which is clear of the exit path of the strip of dunnage.

The machine 12 may be controlled in any suitable manner. The illustrated machine is equipped with a sensor 115 for sensing the presence of a pad in the discharge chute. The machines' controller may operate in a mode which upon sensing the removal of a formed pad from the discharge chute, the machine is operated to produce a new pad and the sever the same automatically. Of course, other known operational modes may be used for various applications.

Although the invention has been shown and described with respect to a certain preferred embodiment or embodiments, equivalent alterations and modifications will occur to others skilled in the art upon the reading and understanding of this specification and the annexed drawings. In particular regard to the various functions performed by the above described integers (components, assemblies, devices, compositions, etc.), the terms (including a reference to a "means") used to describe such integers are intended to correspond, unless otherwise indicated, to any integer which performs the specified function of the described integer (i.e., that is functionally equivalent), even though not structurally equivalent to the disclosed structure which performs the function in the herein illustrated exemplary embodiment or embodiments of the invention. In addition, while a particular feature of the invention may have been described above with respect to only one of several illustrated embodiments, such feature may be combined with one or more other features of the other embodiments, as may be desired and advantageous for any given or particular application.

What is claimed is:

1. A cushioning conversion machine for converting a sheet stock material into cushioning products, said machine comprising:

at least one conversion assembly which converts the sheet stock material into a strip of dunnage;

an outlet through which the strip of dunnage emerges and which defines an exit path of the strip of dunnage; and a capture device disposed in the exit path of the strip of dunnage emerging from the outlet and being operative to cause the emerging strip of dunnage to be progressively bent into a U-shape and then removed while retaining the U-shape, wherein said capture device includes a holder for capturing a leading end of the strip of dunnage emerging from said outlet and for holding the leading end fixed within said holder such that the emerging strip is caused to be progressively bent into the U-shape.

2. A cushioning conversion machine as set forth in claim 1, wherein said holder is mounted with respect to said outlet for movement relative to said outlet between a first position disposed in the exit path of the strip of dunnage emerging from the outlet and a second position relatively rotated and transversely offset from said first position, and said holder is operative to hold the leading end of the strip of dunnage for rotating movement with said holder as said holder is caused by the emerging strip to move from said first position to said second relatively rotated position, whereby the emerging strip is caused to be progressively bent into a U-shape.

3. A cushioning conversion machine as set forth in claim 2, wherein said outlet includes a guide chute.

4. A cushioning conversion machine as set forth in claim 3, wherein said holder is mounted to said guide chute for pivotal movement between said first position and said second position, said second position being rotated about 140° from said first position.

5. A cushioning conversion machine as set forth in claim 2, wherein said holder is normally biased towards said first position.

6. A cushioning conversion machine as set forth in claim 1, wherein said holder includes a pocket in which the leading end of the strip of dunnage is received and held.

7. A cushioning conversion machine as set forth in claim 6, wherein said pocket has a relatively wide mouth for receiving the leading end of the strip of dunnage and converging side walls between which the leading end of the strip of dunnage can be wedged for secure holding of the leading end of the strip of dunnage in the holder.

8. A cushioning conversion machine as set forth in claim 1, wherein said at least one conversion assembly produces a strip of dunnage having in cross section a major axis and a minor axis, said machine is oriented such that the major axis extends vertically, and said capture device is oriented so as to cause the strip of dunnage to be bent in a horizontal plane.

9. A cushioning conversion machine as set forth in claim 1, wherein said at least one conversion assembly produces a continuous strip of dunnage and a severing mechanism is provided adjacent said outlet for severing a dunnage product from a strip of dunnage.

10. A cushioning conversion machine as set forth in claim 1, wherein the emerging strip of dunnage progressively deflects at least a portion of the strip of dunnage out of the exit path to form the U-shape strip.

11. A method of forming a U-shape strip of dunnage from sheet stock material, said method comprising the steps of:

converting the sheet stock material into a strip of dunnage using a conversion machine having at least one conversion assembly and an outlet through which the strip of dunnage emerges and which defines an exit path of the strip of dunnage; and capturing the leading end of the strip of dunnage as it emerges from the outlet and holding the leading end in a fixed position within a holder so as to cause the emerging strip of dunnage to be progressively bent into a U-shape; and then removing the strip of dunnage from the machine while retaining the U-shape.

12. A method as set forth in claim 11, wherein the holder is mounted with respect to the outlet for movement relative to the outlet between a first position disposed in the exit path of the strip of dunnage emerging from the outlet and a second position relatively rotated and transversely offset from the first position, and the holder is operative to hold the leading end of the strip of dunnage for rotating movement with the holder as the holder is caused by the emerging strip to move from the first position to the second relatively rotated position, whereby the emerging strip is caused to be progressively bent into a U-shape.

13. A method as set forth in claim 12, including the step of using a guide chute to guide the strip emerging through the outlet.

14. A method as set forth in claim 13, wherein the holder is mounted to the guide chute for pivotal movement through about 140° between the first position and the second position.

15. A method as set forth in claim 12, wherein the holder is normally biased towards the first position.

16. A method as set forth in 11, wherein the holder includes a pocket in which the leading end of the strip of dunnage is received and held.

17. A method as set forth in claim 16, wherein the pocket has a relatively wide mouth for receiving the leading end of the strip of dunnage and converging side walls between which the leading end of the strip of dunnage can be wedged for secure holding of the leading end of the strip of dunnage in the holder.

18. A method as set forth in claim 11, wherein the converting step includes producing a strip of dunnage having in cross section a major axis and a minor axis, with the major axis extending vertically, and the capturing step includes bending the strip of dunnage in a horizontal plane.

19. A method as set forth in claim 11, wherein the converting step includes producing a continuous strip of dunnage and a severing mechanism is used for severing the strip of dunnage from a successively formed strip of dunnage.

20. A U-shape strip of dunnage produced in accordance with the method of claim 11.

21. A cushioning conversion machine for converting sheet stock material into cushioning products, said machine comprising:

at least one conversion assembly which converts the sheet stock material into a strip of dunnage;

an outlet through which the strip of dunnage emerges and which defines an exit path of the strip of dunnage; and a capture device disposed in the exit path of the strip of dunnage which engages a leading end of the strip of dunnage and rotates the leading end of the strip of dunnage between a first position disposed in the exit path of the strip of dunnage and a second position relatively rotated and transversely offset from said first position as the strip of dunnage emerges from the outlet to progressively bend the strip of dunnage into a U-shape.

* * * * *